United States Patent [19]

Führing et al.

[11] 3,949,485

[45] Apr. 13, 1976

[54] METHOD OF AND APPARATUS FOR DRYING ARTICLES IN CONTACT WITH AN ORGANIC SOLVENT

[75] Inventors: Heinrich Führing, Augsburg; Johannes Helmut Sieber, Aystetten, both of Germany

[73] Assignee: Firma Böwe Bröhler & Weber K G, Augsburg, Germany

[22] Filed: Aug. 28, 1973

[21] Appl. No.: 392,336

[30] Foreign Application Priority Data

Aug. 30, 1972 Germany ..... 2242632

[52] U.S. Cl. ..... 34/15; 34/30; 34/48; 34/51

[51] Int. Cl.[2] ..... F26B 5/04

[58] Field of Search ..... 34/9, 15, 30, 51, 219, 34/31, 92, 54, 131, 132, 48

[56] References Cited

UNITED STATES PATENTS

| | | | |
|---|---|---|---|
| 2,573,966 | 11/1951 | Hamlin | 34/15 X |
| 2,574,298 | 11/1951 | Smith | 34/92 X |
| 2,929,151 | 3/1960 | Hicks | 34/51 X |
| 3,163,029 | 12/1964 | Jacobs | 34/54 |
| 3,256,613 | 6/1966 | Moulthrop | 34/15 |
| R24,260 | 12/1956 | Thies | 34/15 |

*Primary Examiner*—Wendell E. Burns
*Assistant Examiner*—William C. Anderson
*Attorney, Agent, or Firm*—Karl F. Ross; Herbert Dubno

[57] ABSTRACT

The drum of a dry-cleaning apparatus is provided with a circulating heater loop including a heat-exchanger which draws gas out of the drum at one location and reintroduces it at a higher temperature at another location in the drum. A pump is operated to maintain the pressure in the drum substantially uniformly at a subatmospheric pressure so as to compensate for the vapor generated by the heating of the atmosphere in the chamber. Temperature and pressure sensors are provided in the drum to shut off the heater if the pressure and/or temperature rises above a predetermined level. In the method aspects of the invention, the articles in contact with an organic solvent are maintained in a substantially airless atmosphere of the solvent vapor, a portion of which is drawn off at a rate corresponding to the rate of vaporization while the remaining solvent vapor is recirculated after warming.

15 Claims, 2 Drawing Figures

METHOD OF AND APPARATUS FOR DRYING ARTICLES IN CONTACT WITH AN ORGANIC SOLVENT

FIELD OF THE INVENTION

The present invention relates to a method of and an apparatus for drying an object wetted with a vaporizable liquid, especially an organic solvent. More specifically this invention concerns a system for drying articles of clothing or other solvent-wetted articles in a dry-cleaning machine or like apparatus.

BACKGROUND OF THE INVENTION

In a conventional dry-cleaning machine the articles being cleaned, usually clothing, are trumbled in a perforated drum while a chlorinated and/or fluorinated-hydrocarbon solvent such as perchlorethylene, trichlorotrifluoroethane, or trichloromonofluoromethane is passed through them. Water and a soap or detergent may be added to the solvent and the mixture is continuously filtered and recirculated until the garments are clean.

For drying it is conventional to admit air to the drum while evacuating it and condensing the solvent from the evacuated air-vapor mixture. Unfortunately with such a system as the garments dry the percentage of solvent vapor in the extracted gas decreases until the condenser is almost totally ineffective.

Other drying methods have been proposed which use, for instance, complicated indirect heating of the solvent-soaked garments for vaporization of the solvent. None of the methods allow the garments to be dried quickly and inexpensively with a good recovery of solvent. Furthermore none of the methods are effective for use with objects other than garments. Degreasing of metal parts, cleaning of leather or hides, or the like is virtually impossible with the known methods since they are either heated excessively or insufficiently.

OBJECTS OF THE INVENTION

It is therefore an object of this invention to provide an improved drying method and apparatus.

Another object is the provision of a method of drying an object wetted with a vaporizable liquid which overcomes the above-given disadvantages.

SUMMARY OF THE INVENTION

These objects are attained according to the present invention in a system wherein the chamber is maintained under subatmospheric pressure and the gas in the chamber is heated directly by passing it over a heater. The gas in the chamber is withdrawn at a rate to maintain the pressure constant, i.e.: the amount of solvent vaporized per unit time is equal to the amount of gas extracted per unit time. The treatment chamber is evacuated of approximately 90% of its gas so that virtually all of the gas extracted by the pump is evaporated solvent. A pressure of 70 Torr has been found advantageous when working with perchlorethylene.

In accordance with this invention the chamber is formed with a closed conduit loop opening at one end into the treatment drum adjacent its periphery and at the other end at the center of rotation therefor. A heat-exchanger and a blower for circulating air through the loop and over the heat-exchanger is provided in the loop.

According to yet another feature of this invention pressure and temperature sensors are provided in the treatment chamber and are connected to the heating means to prevent further heating of the gas in the chamber once the pressure and/or temperature rise above a predetermined level. More specifically the heater is controlled thermostatically to maintain an even temperature in the chamber whereas the pressure sensor may override the thermostat to shut the heater down when pressure starts to build up beyond the capacity of the pump to evacuate the chamber. Such a method gives optimum heat exchange to the objects to be dried since the pressure remains constant and the heat-exchange rate also remains constant. When the pressure drops as would happen in an uncontrolled system, the heat-exchange or heat-transfer rate also drops since the medium is thinned. With increased pressure the heat-exchange rate increases so that the heater might burn or otherwise damage the objects being dried.

Such a system can be used for a dry-cleaning machine. in addition it can be employed for the cleaning of pelts or leather, and even for degreasing metal parts. A sure and fast drying is attained. Furthermore it has been surprisingly found that almost regardless of the amount of solvent to be removed by drying, the drying cycle takes the same time. The invention is based upon our discovery that effective heat exchange may be effected through the vapor, usually of a higher density than that of air, with the articles to expedite vaporization of the liquid solvent.

Thus, according to the invention, drying of articles contacted or impregnated with an organic solvent, especially one of the chlorinated hydrocarbons or fluorochlorinated hydrocarbons mentioned previously, are dried by agitating them in a substantially air-free environment consisting of vapor or solvent, withdrawing from the environment of the articles a portion of the solvent vapor corresponding to the quantity of vapor generated by volatilization of the liquid solvent, and recirculating from the region of the article back to this region, the remainder of the solvent vapor while heating same to the temperature of the article and produce volatilization of the liquid solvent. This relationship is maintained at least during the initial drying phase while liquid solvent is in contact with the articles.

The articles preferably are fabrics subjected to a dry-cleaning or to another fabric treatment in the presence of the solvent or in the absence thereof with subsequent solvent treatment, pelts, leather articles or metal articles which are degreased in the solvent.

According to an important feature of the invention, the pressure during volatilization of the liquid-solvent phase in contact with the article is maintained to a subatmospheric level, preferably 70 Torr, the heating of the reciculated vapor and the rate at which vapor is removed from the environment of the articles being controlled accordingly. A sensor may be provided for the pressure or temperature in the circulating system so that any increase of either pressure or temperature above a predetermined level will result in greater gas evalution or reduced heating. The particular advantageous arrangement provides for heating of the recirculated vapor in a heat exchanger, e.g. by contract with a surface heated indirectly by another fluid.

DESCRIPTION OF THE DRAWING

The above and other objects, features, and advantages of the invention will become readily apparent from the following description, reference being made to the accompanying drawing in which.

SPECIFIC DESCRIPTION

Figure 1:
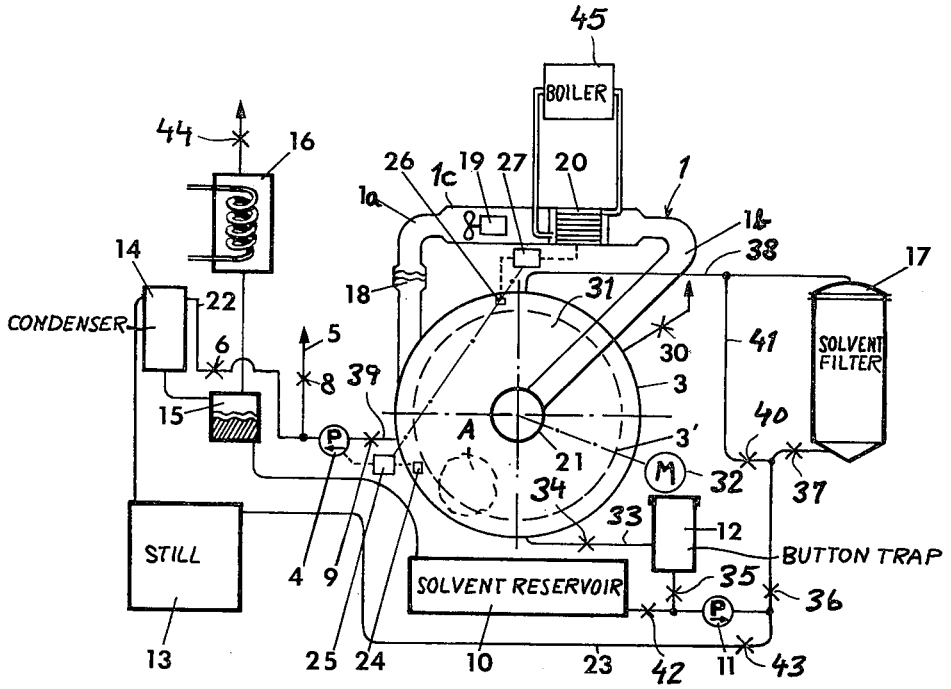
FIG. 1 is a schematic view illustrating the system according to the present invention.

As shown in FIG. 1 an article A to be dried is held in a perforated drum 3′ rotated by a motor 32 within a closed drum 3 defining a gastight chamber 31.

During cleaning a solvent, here perchlorethylene, is drawn out of the bottom of the chamber 31 through a line 33, an open valve 34, a button trap 12, and another valve 35 by a pump 11 which forces the liquid via valves 36 and 37 through a solvent filter 17 and then through another line 38 opening into the top of the chamber 31. During the cleaning cycle the solvent is continuously circulated in the chamber 31 which is first reduced to a subatmospheric pressure by a vacuum pump 4 which draws the air out of the chamber 31 through a line 39 and a valve 9 and expels it to the atmosphere through a valve 8 in a line 5. The filter 17 may be bypassed by closing the valve 37 and by opening a valve 40 in a line 41 shunting this filter. A valve 42 between the input of the pump 11 and a solvent reservoir 10 is closed during the cleaning operation, as is a valve 43 between the pump output and a still 13. A similar system is described in our copending and commonly assigned U.S. patent application Ser. No. 343,535 filed Mar. 21, 1973.

Once the cleaning operation is ended the valve 36 is closed and the valve 43 is opened. The pump 11 forces the solvent through the still 13 and thence to a condenser 14 and a separator 15. Commonly assigned U.S. patent application Ser. No. 347,457 filed on Apr. 3, 1973 by Heinrich Führing and Emil Christof describes such a separator. Thence the solvent is returned to the reservoir 10. The water is boiled off by a reflux cooler 16 connected to the separator and vented to the atmosphere 16 through a valve 44. Operation of the apparatus in this manner while spinning the drum 3′ at high speed extracts much of the solvent from the article A.

In order to dry the article A vapor is drawn out of the back of the chamber 31 adjacent the periphery thereof through a conduit section 1*a* provided with a dust filter 18 by a suction fan 19. Thence the dust-free gas is passed in a section 1*c* of the conduit loop 1 over a heat-exchanger 20 heated by a boiler 45. Thereafter the heated vapor is blown back into the front end of the chamber 31, near the center at the door 21 thereof, through another conduit section 1*b*. This heating of the gas in the chamber 31 vaporizes the solvent, thereby increasing the pressure in the chamber.

As the gas is heated in loop 1 the pump 4 is operated with valves 6 and 9 open and valve 8 closed to pump the gas into the condenser 14 through a line 22. The vaporized perchlorethylene is there condensed and fed back to the reservoir 10. The pump 4 is operated by a control 25 at a rate dependent on the pressure in the chamber 31 as detected by a pressurestat 24 in the chamber so as to maintain a relatively constant pressure therein. Similarly a thermostat 26 in the chamber 31 operates the series-connected boiler 45 and fan 19 through a control 27 in order to maintain an even heat therein to prevent, for example, damaging a woolen sweater or the like being dry-cleaned. The pressurestat 24 is also connected to the heater 19, 20 to turn off this unit when the pressure drops below 70 Torr, since below this pressure the efficiency of the heater 19, 20 is greatly reduced.

When the article A is substantially dry a valve 30 is opened to let air into the chamber and the valve 34 is closed. The pump 4 is operated for a short time to remove fumes from the chamber 31, and then the valve 9 is closed and the entire apparatus can be shut down. Prior to the next cleaning opened and the valve 35 closed while the pump 11 is operated with valves 36 and 37 open to replenish the supply of solvent in the filter 17.

It should be noted that the controls 25 and 27 are interconnected so that the pump is operated and the boiler 45 is operated to maintain a relatively constant temperature and pressure in the chamber. The pump 4 is originally started after the ventilator 19 and only when the pressure in the chamber 31 rises above a predetermined level. Similarly if the pressure rises above a level which the pump 4 can handle, the control 25 stops the ventilator 19 and/or heater 20 to arrest the heating of the gas in the chamber 31.

Figure 2:
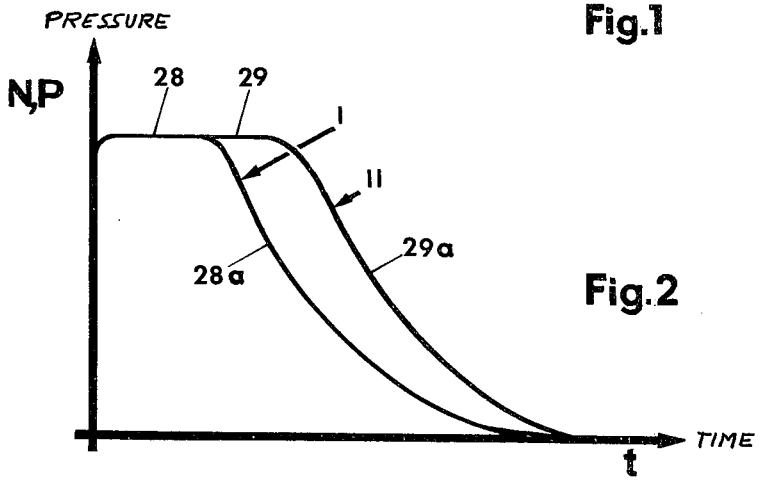
FIG. 2 is a graph illustrating principles of this invention.

The graph of FIG. 2 shows on its abscissa time *t* and on its ordinate pressure P which is proportional to the amount N of heat which can be transmitted to the articles in the drum chamber 31. It should be clear that the pressure or the amount of gas in the system remains relatively constant at the beginning of the drying cycle, but then drops off rapidly. Curve I corresponds to a dry-cleaning load which carries a relatively small amount of solvent since after the initial relatively level portion 28 the curve drops gradually as shown at 28*a*. For more heavily laden goods the curve II continues level at 29, then drops more rapidly as shown by section 29*a*. Surprisingly both curves I and II finish at approximately the same instant in time. Thus regardless of the load size the drying time is substantially equal.

The system according to this invention allows dry-cleaned articles, or indeed anything which is wetted with a vaporizable liquid, to be dried rapidly and efficiently with a minimum expenditure of energy and without overly heating the wet article. The apparatus used is simple and relatively foolproof, and allows the valuable solvent to be recovered with practically no losses.

We claim:

1. A method of drying an object wetted with a vaporizable liquid solvent comprising the steps of:

enclosing said object in a substantially gastight chamber and evacuating air therefrom;

passing air-free gas in the form of vapor of said solvent in said chamber over a heater to heat the gas and evaporate the liquid on said object;

simultaneously withdrawing gas and evaporated solvent from said chamber at a rate to maintain a substantially constant gas pressure in said chamber;

recovering solvent from said gas; and recirculating said gas to said chamber to entrain additional evaporated solvent therein.

2. The method defined in claim 1 wherein said chamber is continuously maintained at a subatmospheric pressure.

3. The method defined in claim 1, further comprising the step of detecting the pressure in said chamber and heating said gas only when said pressure is below a predetermined level.

4. The method defined in claim 1, further comprising the step of detecting the temperature of said gas in said chamber and heating said gas only when said temperature is below a predetermined level.

5. A method of drying articles in contact with an organic solvent, comprising the steps of:

heating said articles exclusively by contact with a heated vapor of said solvent to volatilize liquid solvent in contact with said articles and in a subsequently air-free environment;

withdrawing from said environment vapor of said solvent at a rate subsequently equal to the rate at which vapor is evolved from liquid solvent in contact with said articles at least for a period of time during which liquid solvent remain in contact with said articles;

recirculating a portion of vapor of said solvent from said environment along a closed path back into the region of said article;

heating the recirculated vapor along said path to heat the solvent in contact with said articles; and maintaining the pressure of said environment substantially constant during the evaporation of liquid solvent by controlling heating of the recirculated solvent vapor and the rate of withdrawal of solvent vapor from said environment concomittantly; and excluding air from said environment.

6. The method defined in claim 5 wherein said articles are fabric, pelts, leather or metal bodies, said solvent is a chlorinated or fluorochlorinated hydrocarbon, and vapor is evolved from said environment subsequent to the termination of evaluation of vapor from liquid solvent in contact with the article by reducing the pressure in said environment below that during evolution of vapor from liquid solvent in contact with said article.

7. The method defined in claim 6 wherein said pressure is maintained substantially constant during evolution of solvent vapor from liquid solvent in contact with said article.

8. The method defined in claim 7 wherein the substantially constant pressure is below atmospheric pressure.

9. The method defined in claim 8 wherein said articles are tumbled in said environment.

10. The method defined in claim 9 wherein one of the parameters: pressure and temperature of said environment is detected and used to control the heating of the recirculated vapor to maintain said substantially constant pressure.

11. The method defined in claim 9 wherein one of the parameters: pressure and temperature of said environment is detected and used to control evolution of vapor to maintain said substantially constant pressure.

12. An apparatus for drying objects wetted with an evaporable liquid in the form of an organic solvent, said apparatus comprising:

a substantially gastight chamber enclosing said objects and means for evacuating air therefrom;

heater means including a heat-exchanger and means for passing vapor of said solvent from said chamber over said heat-exchanger for heating said vapor;

pump means for recirculating heated solvent vapor to said chamber from said heat exchanger; and control means connected to said chamber and to said pump means for maintaining the gas pressure in said chamber generally uniform during the recirculation of heated solvent vapor thereto, said chamber including a closed drum and said recirculating means including a conduit loop containing said heat-exchanger and having ends connected to said drum at different locations thereon, said means for passing solvent vapor over said heat-exchanger including a blower in said loop, said blower and said ends being arranged to draw solvent vapor out of said drum peripherally of the drum and to reintroduce the solvent vapor into said drum centrally while excluding air from said drum.

13. The apparatus defined in claim 12 wherein said control means includes a pressure sensor in said chamber and means for operating said heater means only when the pressure in said chamber is below a predetermined level.

14. The apparatus defined in claim 12 wherein said control means includes a temperature sensor in said chamber and means for operating said heater means only when the temperature in said chamber is below a predetermined level.

15. The apparatus defined in claim 12 wherein said chamber is at least partially formed of the drum of a dry-cleaning apparatus.

* * * * *